US007390069B1

(12) United States Patent
Ho

(10) Patent No.: US 7,390,069 B1
(45) Date of Patent: Jun. 24, 2008

(54) READY-TO-ASSEMBLE MODULAR DESK

(75) Inventor: Wen-Te Ho, Taichung (TW)

(73) Assignee: Grace Chance Enterprise Co., Ltd., Shenzhe, Guangdong Province (CN)

( * ) Notice: Subject to any disclaimer, the term of this patent is extended or adjusted under 35 U.S.C. 154(b) by 0 days.

(21) Appl. No.: 11/777,903

(22) Filed: Jul. 13, 2007

(51) Int. Cl.
*A47B 47/00* (2006.01)

(52) U.S. Cl. ..... 312/195; 312/257.1; 312/263

(58) Field of Classification Search ..... 312/257.1, 312/263, 265.5, 194, 195, 107, 111, 223.3, 312/140; 108/50.01, 50.02, 50.11, 64; 24/287, 24/DIG. 53; 411/349, 549, 550, 553; 403/231, 403/409.1, DIG. 12, DIG. 13, 348, 349
See application file for complete search history.

(56) References Cited

U.S. PATENT DOCUMENTS

| | | | | | |
|---|---|---|---|---|---|
| 2,967,747 | A * | 1/1961 | Bus | 312/265.5 |
| 3,079,207 | A * | 2/1963 | Deaton | 312/195 |
| 3,207,097 | A * | 9/1965 | Schreyer | 108/92 |
| 4,020,613 | A * | 5/1977 | Reynolds et al. | 403/321 |
| 4,323,291 | A * | 4/1982 | Ball | 312/194 |
| 4,536,044 | A * | 8/1985 | Ziegelheim et al. | 312/195 |
| 4,869,564 | A * | 9/1989 | Lechman | 312/195 |
| 4,886,326 | A * | 12/1989 | Kuzyk | 312/257.1 |
| 5,359,944 | A * | 11/1994 | Steinbeck | 403/294 |
| 5,472,269 | A * | 12/1995 | Novikoff | 312/263 |
| 5,667,327 | A * | 9/1997 | Salice | 403/231 |
| 5,678,948 | A * | 10/1997 | White | 403/321 |
| 5,762,442 | A * | 6/1998 | Salice | 403/231 |
| 5,823,700 | A * | 10/1998 | Poworoznek | 403/245 |
| 6,676,231 | B1 * | 1/2004 | Kelley et al. | 312/107 |

* cited by examiner

*Primary Examiner*—James O Hansen
(74) *Attorney, Agent, or Firm*—patenttm.us

(57) ABSTRACT

A ready-to-assemble (RTA) modular desk has multiple clasp connectors, two desk assemblies a door and at least one pedestal drawer. Each desk assembly has a pedestal, and a desktop having a bottom surface. The pedestal and a stand are constructed and mounted detachably on bottom surface of the desktop by using the clasp connectors. The desk assemblies are connected detachably to the each other using multiple latch assemblies. The door is mounted detachably on one of the pedestals. The pedestal drawers are mounted detachably in one of the pedestals. Therefore, the RTA modular desk can be assembled without using tools in a variety of orientations, allowing a person to customize the RTA modular desk to their needs and easily change or disassemble the RTA modular desk without using tools.

4 Claims, 10 Drawing Sheets

READY-TO-ASSEMBLE MODULAR DESK

BACKGROUND OF THE INVENTION

1. Field of Invention

The present invention relates to a modular desk, and more particularly to a ready-to-assemble modular desk.

2. Description of the Related Art

Ready-to-assemble (RTA) furniture has many advantages including, being cheap to manufacture, easy to assemble and saves space during transportation and storage.

However, a person can only assemble RTA furniture as designed so an RTA desk has a set orientation and the person cannot customize the number and orientation of drawers, shelves and desktops. Moreover, the RTA desk requires tools for assembly and disassembly that dissuades some people from buying the RTA desk.

The present invention provides a ready-to-assemble modular desk to obviate or mitigate the shortcomings of the conventional RTA desk.

SUMMARY OF THE INVENTION

The primary objective of the present invention is to provide a ready-to-assemble (RTA) modular desk that is easily assembled and disassembled, and allows a person to customize the RTA modular desk.

The RTA modular desk in accordance with the present invention has multiple clasp connectors, two desk assemblies, a door and at least one pedestal drawer. Each desk assembly has a pedestal, and a desktop having a bottom surface. The pedestal and a stand are constructed and mounted detachably on the bottom surface of the desktop using the clasp connectors.

The desk assemblies are connected detachably to each other using multiple latch assemblies. The door is mounted detachably on one of the pedestals. The pedestal drawers are mounted detachably in one of the pedestals. Therefore, the RTA modular desk can be assembled without using tools in a variety of orientations, allowing a person to customize the RTA modular desk to their needs and easily change or disassemble the RTA modular desk without using tools.

Other objectives, advantages and novel features of the invention will become more apparent from the following detailed description when taken in conjunction with the accompanying drawings.

DETAILED DESCRIPTION OF THE INVENTION

Figure 1:
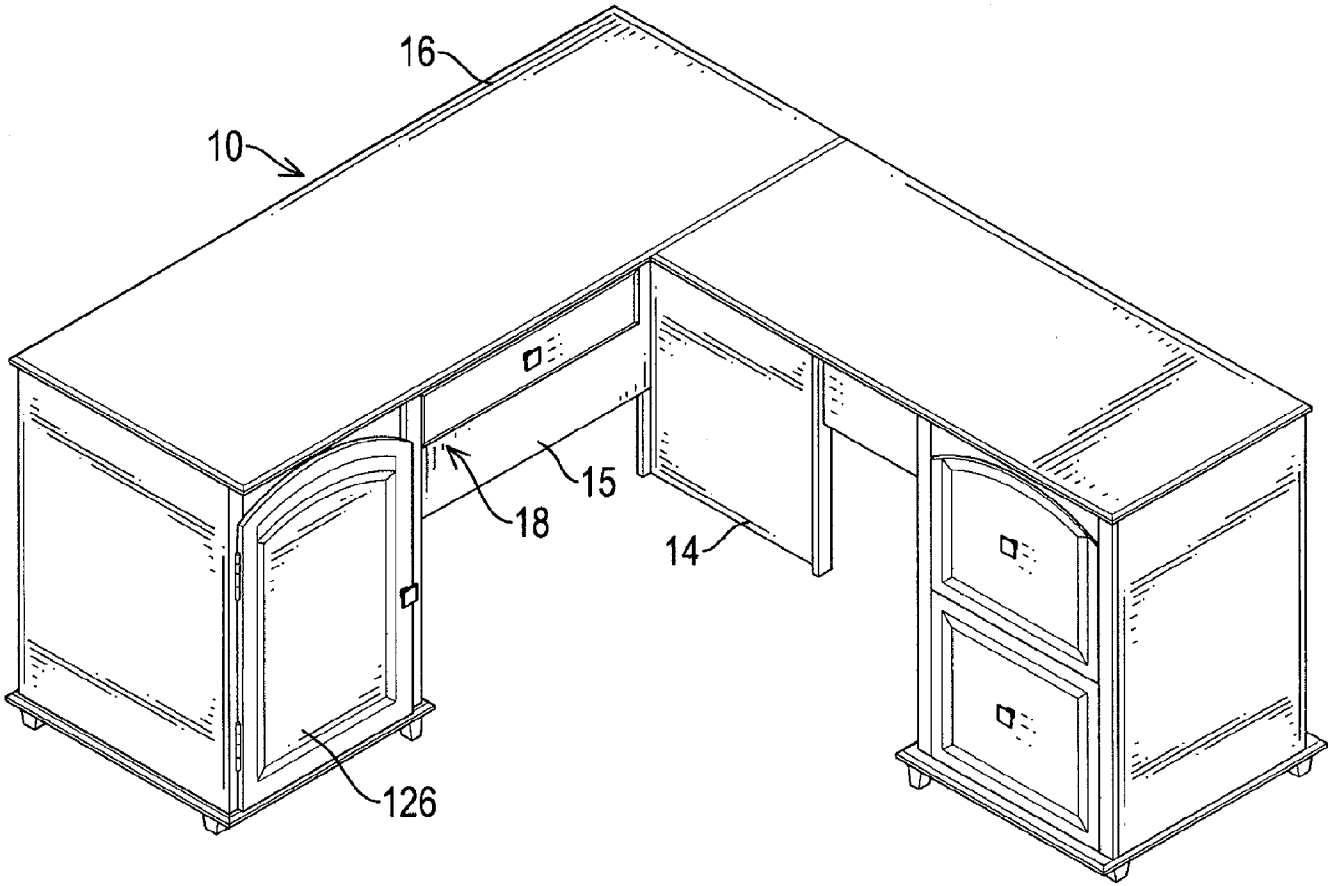
FIG. 1 is a perspective view of a first embodiment of a ready-to-assemble (RTA) modular desk in accordance of the present invention.
Figure 2:
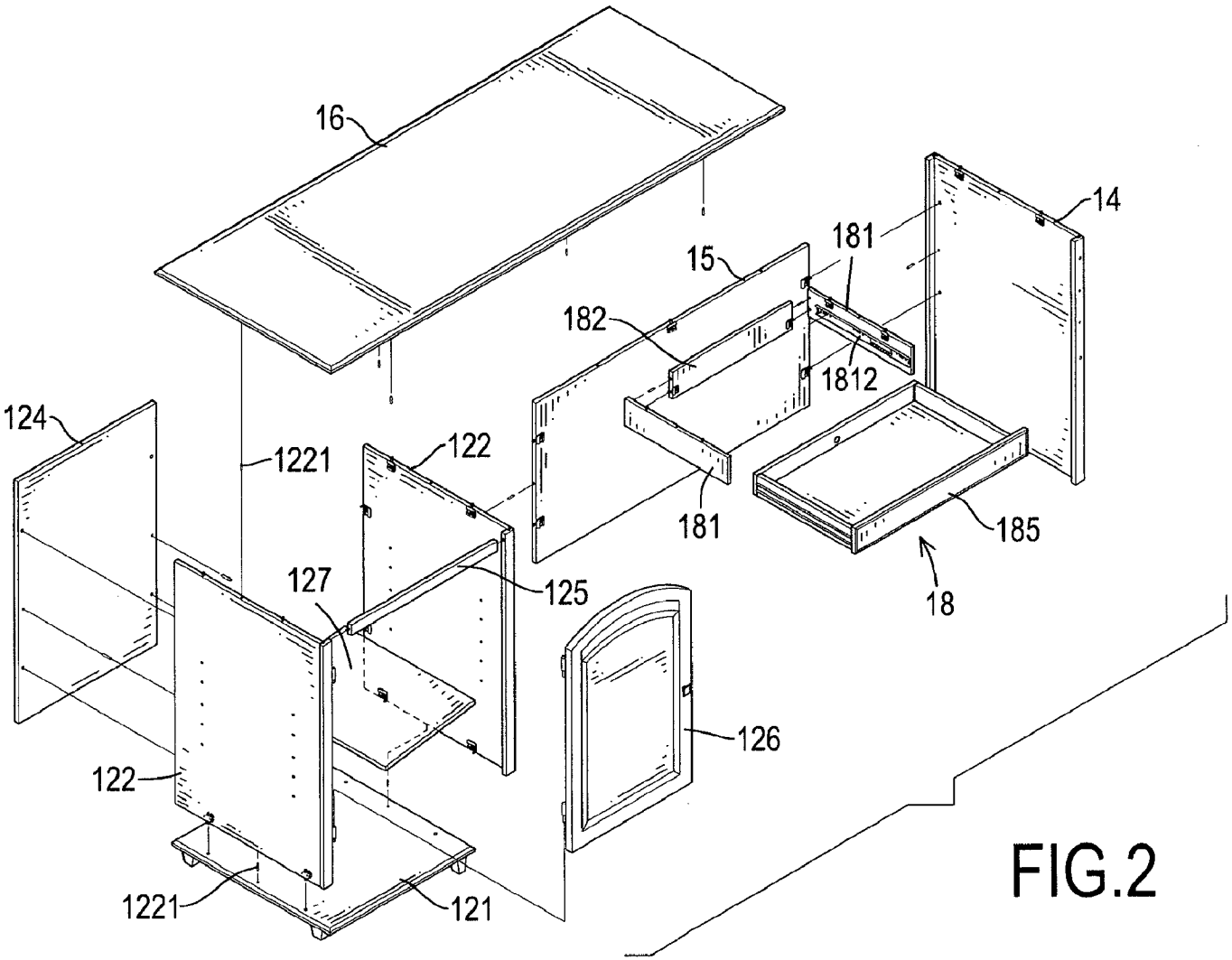
FIG. 2 is an exploded perspective view of a desk assembly of the RTA desk in FIG. 1.
Figure 6:
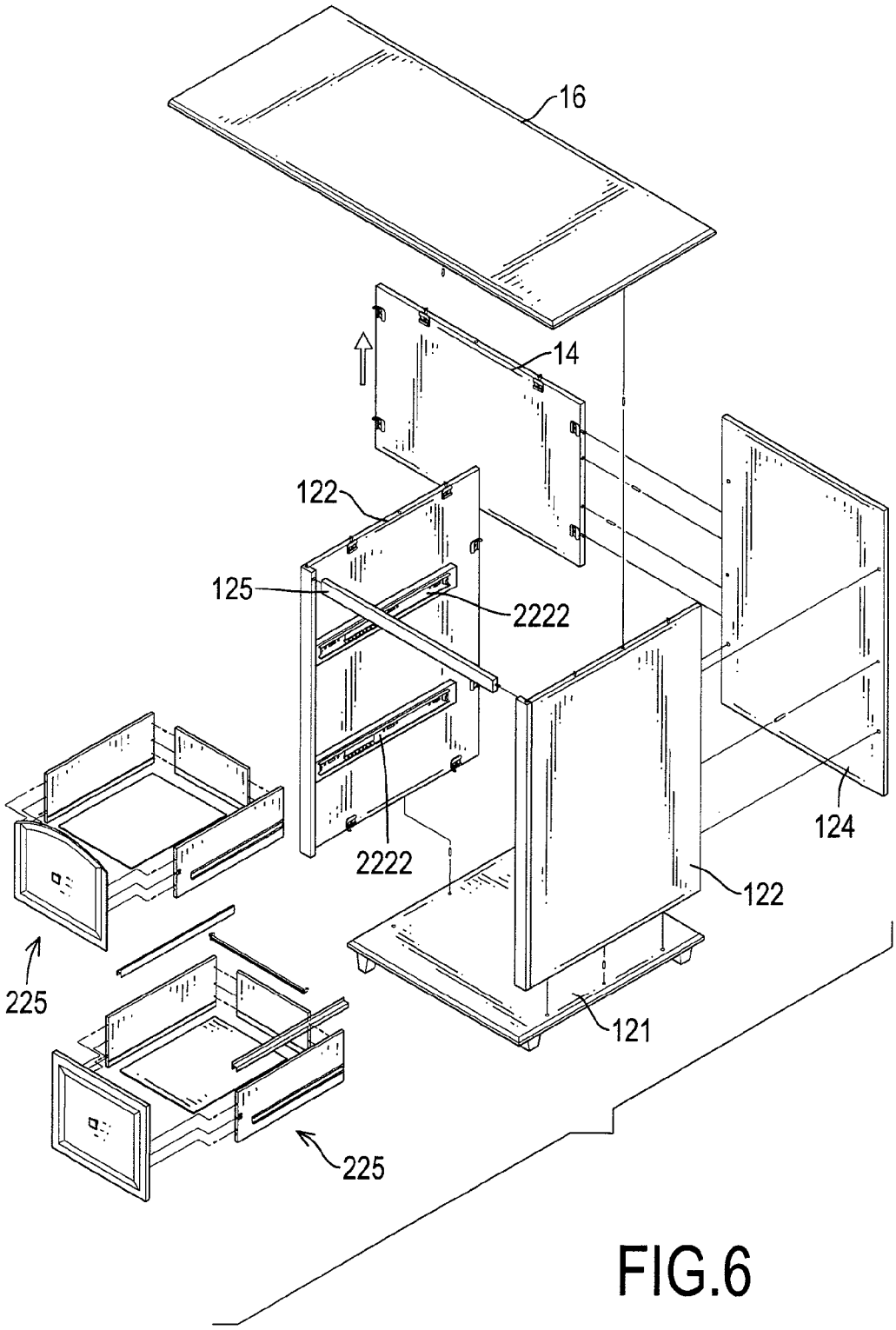
FIG. 6 is an exploded perspective view of a pedestal of a desk assembly of the RTA desk in FIG. 1.

With reference to FIGS. 1, 2 and 6, a ready-to-assemble modular desk in accordance with the present invention comprises multiple clasp connectors, two desk assemblies (10), an optional drawer assembly (18), a door (126), an optional shelf (127) and at least one pedestal drawer (225).

Figure 8:
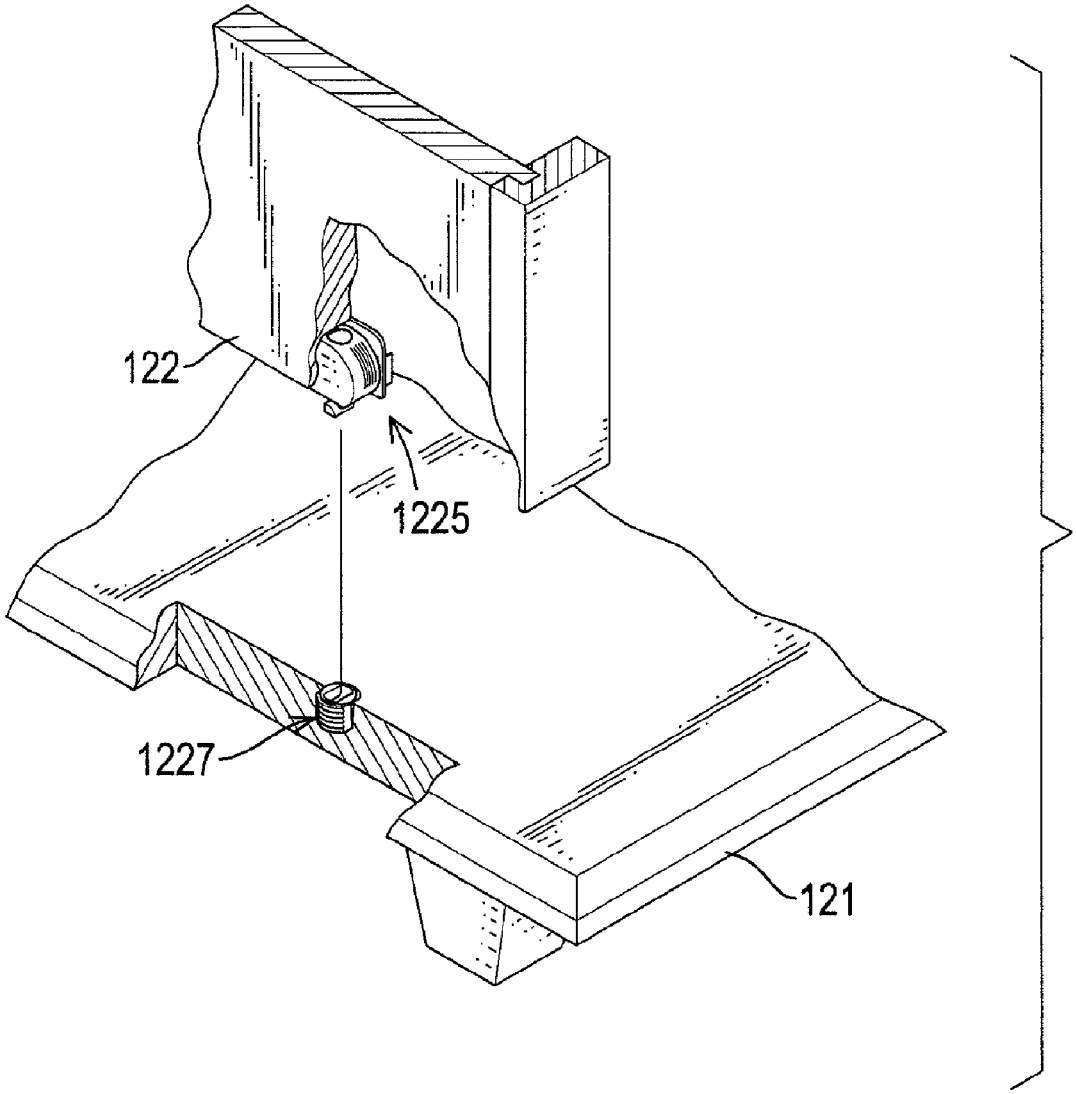
FIG. 8 is an enlarged perspective view in partial section of a clasp assembly used to construct the RTA modular desk assembly in FIG. 1.
Figure 9:
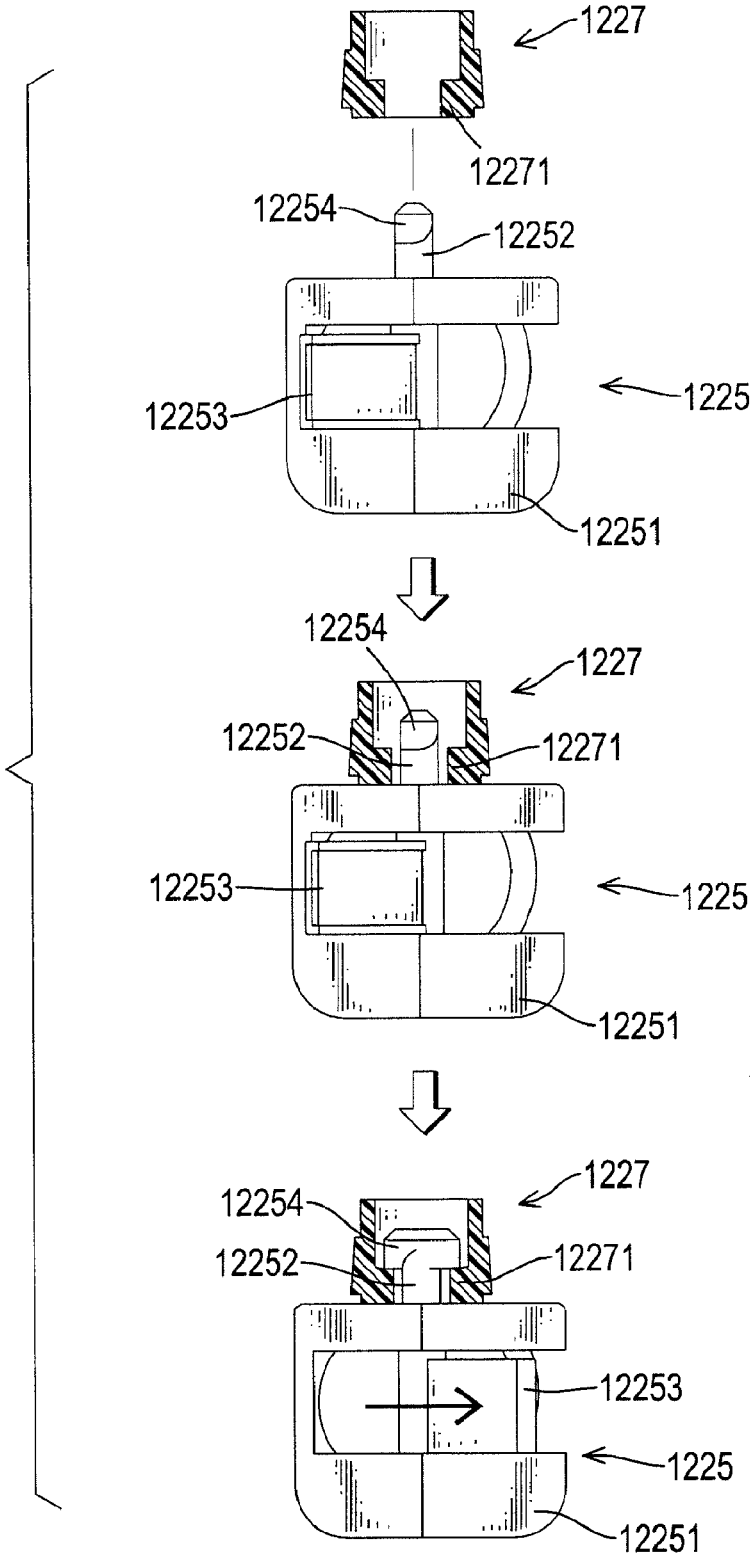
FIG. 9 is operational top views in partial section of the clasp assembly in FIG. 8.

With reference to FIGS. 8, and 9, each clasp connector comprises a clasp bar (1225) and a clasp recess (1227).

Each clasp recess (1227) has an inner chamber and a shoulder (12271). The shoulder (12271) is formed on and protrudes from the inner chamber of the clasp recess (1227) and corresponds to the head (12254) on the rotating pin (12252).

Each clasp recess (1227) has an inner chamber and a shoulder (12271). The shoulder (12271) is formed on and protrudes from the inner chamber of the clasp recess (1227).

Each clasp bar (1225) comprises a base (12251) and a rotating pin (12252). The rotating pin (12252) has a neck, a lever (12253) and a head (12254). The neck of the rotating pin (12252) protrudes from the base (12251). The lever (12253) is mounted on the rotating pin (12252) to rotate the rotating pin (12252). The head (12254) is formed on and protrudes from the neck of the rotating pin (12252) and corresponds to the inner chamber of the clasp recess (1227). The head (12254) on the rotating pin (12252) of the clasp bars (1225) is inserted into the corresponding clasp recess (1227) and extends through the shoulder (12271) of the clasp recess (1227), the rotating pin (12252) is rotated so the head (12254) abuts the shoulder of the clasp recess (1227) to lock the clasp connector securely.

Each desk assembly (10) has a pedestal (12), an optional stand (14), an optional rear cover (15), and a desktop (16).

With further reference to FIGS. 2, 3A, 3B, and 6, the pedestal (12) comprises a pedestal base (121), two pedestal side panels (122), a pedestal rear panel (124) and a pedestal brace (125).

The pedestal base (121) is rectangular and has a rear edge and two side edges.

The pedestal side panels (122) have an inner surface, a bottom edge, a top edge and a rear edge. The bottom edges of the pedestal side panels (122) are mounted removably on to the side edges of the pedestal base (121) using the at least one clasp connector and the at least one dowel (1221).

Each inner surface of the pedestal panels (122) has multiple hole pairs formed in the inner surface corresponding to each other.

The pedestal rear panel (124) corresponds to and is mounted removably on the pedestal base (121) and the pedestal side panels (122) using the clasp connectors and the at least one dowel (1221).

The pedestal top brace (125) is connected between the pedestal side panels (122) using the clasp connectors.

The stand (14) comprises at least one leg, may be rectangular and is placed parallelly to the pedestal side panels (122) and has an inner surface, a top edge, a front edge and a rear edge.

The rear cover (15) is a rectangular board and has a top edge and two side edges. The two side edges are shorter then the leg of the stand (14) and are detachably mounted to the rear edge of the pedestal side panel (123) and the stand (14) using the multiple clasp connectors and the at least one dowel (1221).

The desktop (16) is rectangular, has a bottom surface, two side edges, a rear edge and a front edge. The edges of the desktop (16) are mounted removably on the top edge of pedestal side panel (122), the top edge of the stand (14) and the top edge of the rear cover (15) using the multiple clasp connectors and the at least one dowel (1221).

Figure 7B:
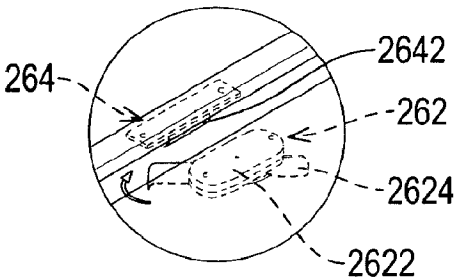
FIG. 7B is an enlarged view of a latch and a catch in FIG. 7A.
Figure 7A:
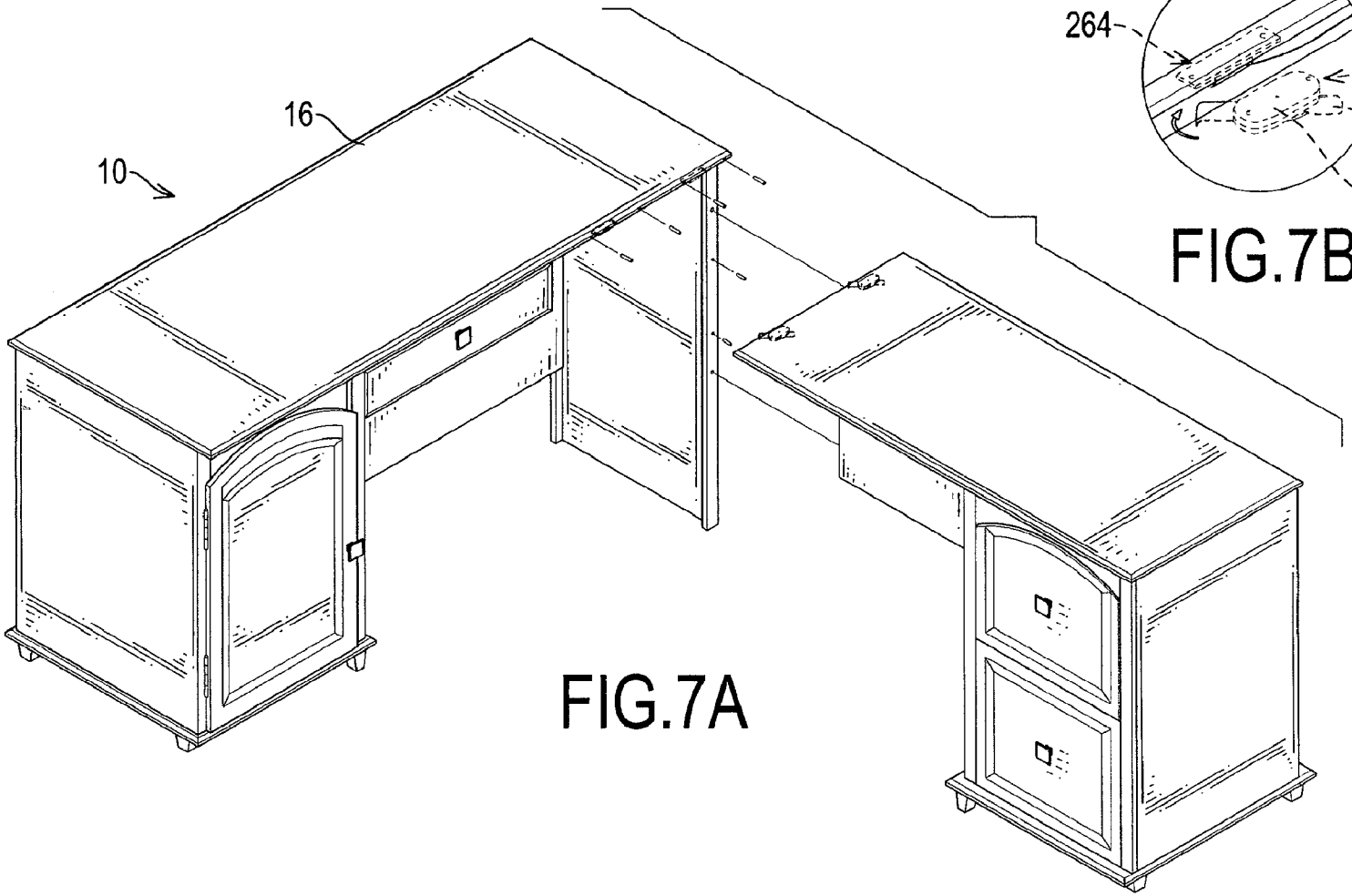
FIG. 7A is a partially exploded perspective view of the desk assemblies in FIG. 1, showing a latch assembly.

With further reference to FIGS. 7A and 7B, the side edge of the desktop (16) of one desk assembly (10) is detachably connected to the other along the front edge of the desktop (16) near the stand (14) using multiple latch assemblies and at least one dowel (1221).

Figure 4:
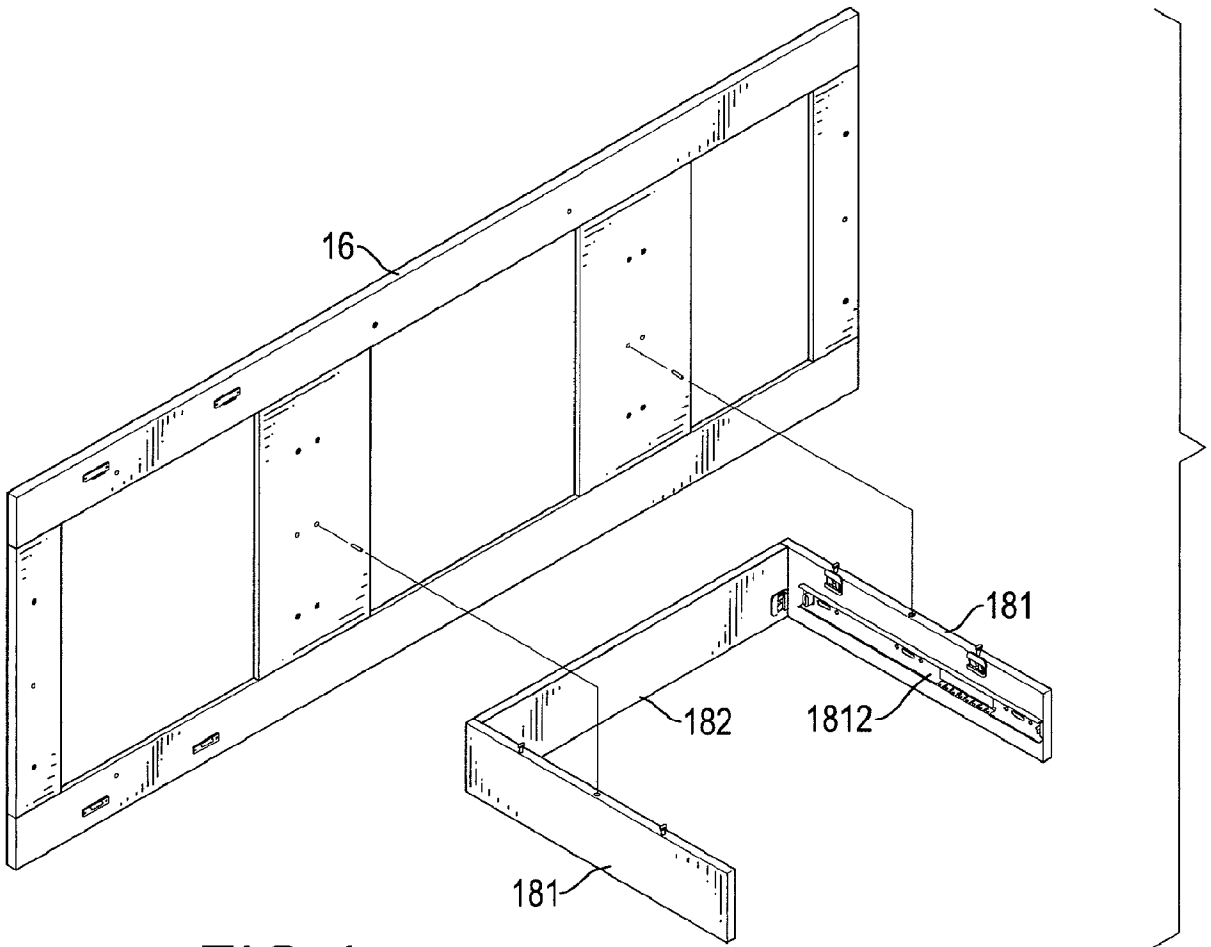
FIG. 4 is a partially exploded perspective view of a desktop and a drawer assembly of the RTA desk in FIG. 1.
Figures 5A, 5B:
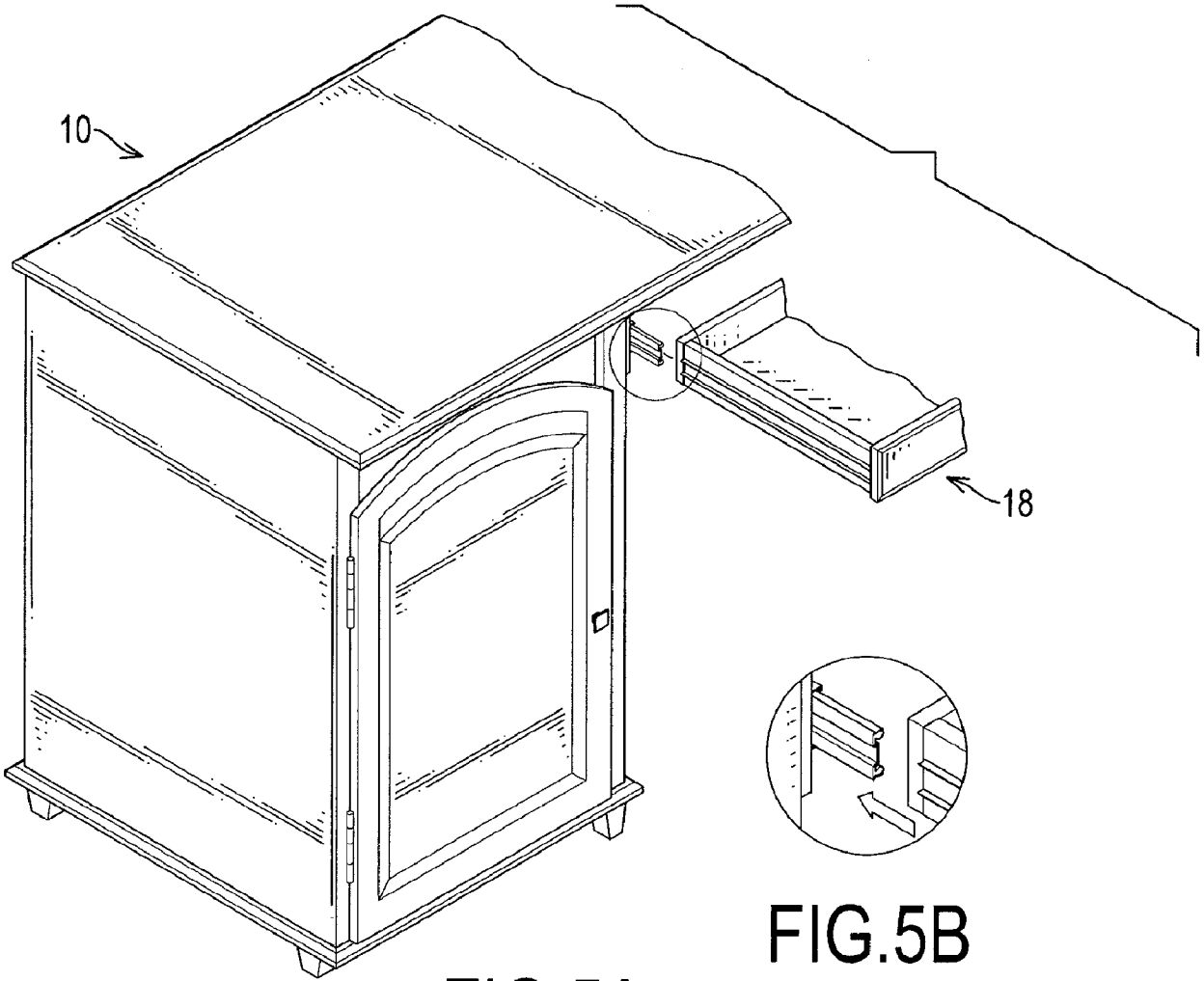
FIG. 5A is a partially exploded view of the desk assembly and the drawer assembly of the RTA desk in FIG. 1.
FIG. 5B is an enlarged assembling view of a drawer and a drawer rail in FIG. 5A.

Each latch assembly has a latch (262) and a catch (264) mounted respectively on the bottom surface of one of the desktops (16). The latch (262) has a latch mount (262) and a latch bar (2624). Each latch bar (264) is mounted rotatably in one of the latch mounts (2622) and has a latching end. Each catch (264) has a recess (2642) corresponding to the latching end of the latch bar (264). With further reference to FIGS. 4, 5A and 5B, each pedestal drawer (225) has two sides and two rails (2222). The rails (2222) are mounted respectively on the sides of the pedestal drawer (225) and in the hole pairs of the inner surface of the pedestal side panels (122) and allow the pedestal drawer (225) to be opened and closed smoothly.

With reference to FIGS. 4, 5A and 5B, the drawer assembly (18) is mounted detachably on the bottom surface of the desktop (16), and has two side drawer panels (181), a rear drawer panel (182), and a drawer (185). The two side drawer panels (181) are mounted parallelly to the pedestal (12) and detachably onto the bottom surface of the desktop (16) using clasp connectors and at least one dowel (1221).

The rear drawer panel (182) is detachably mounted between the side drawer panels (181) using clasp connectors.

The drawer (185) has two side surfaces being slidably mounted between the side drawer panels (181) and two drawer rails (1812). The drawer rails (1812) are mounted respectively on the side surfaces of the drawer (185) and the side drawer panels (181) to allow the drawer (185) to open and close smoothly.

Figure 3B:
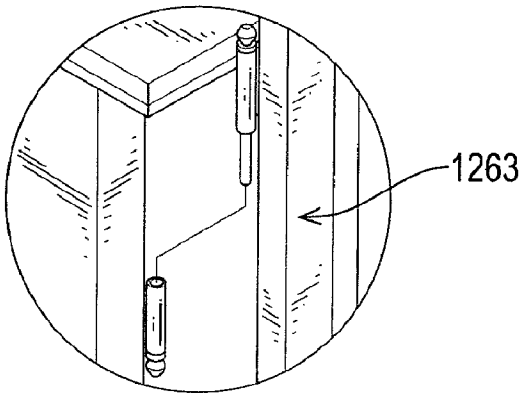
FIG. 3B is an enlarged view of a hinge of the a door in FIG. 3A.
Figure 3A:
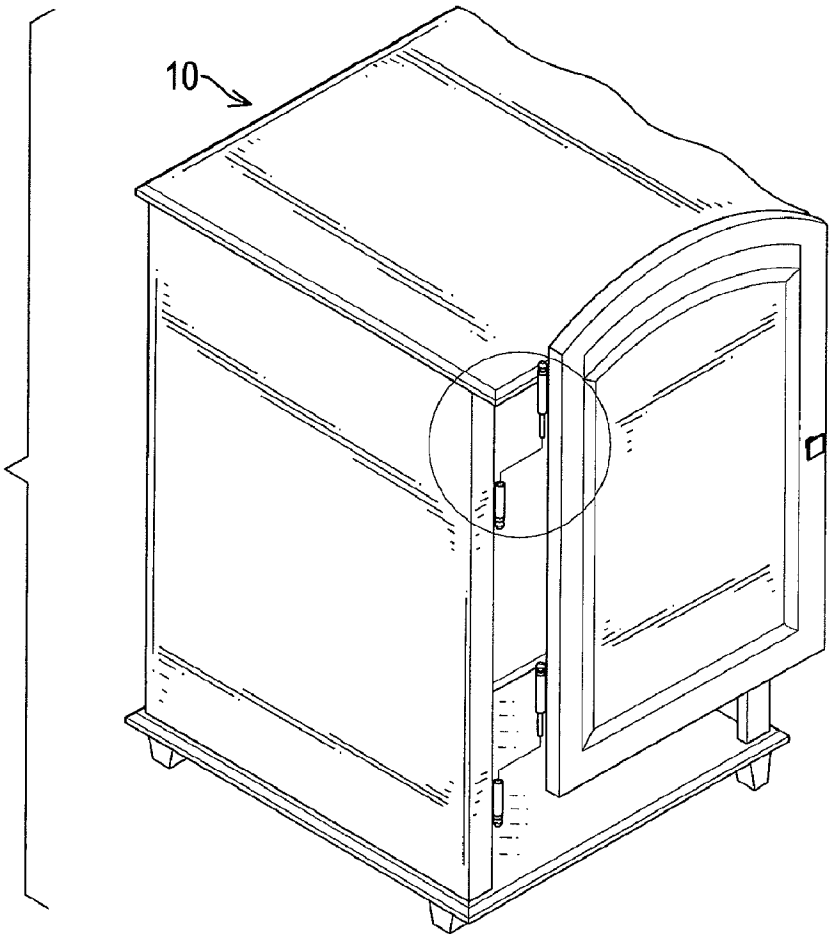
FIG. 3A is an enlarged view of the desk assembly of the RTA desk in FIG. 1.

With reference to FIGS. 3A and 3B, the door (126) has an outer edge and multiple hinges (1263). Each hinge (1263) is mounted pivotally on the outer edge of the door (126) and the corresponding pedestal side panels (122) to allow the door (126) to rotate with respect to the pedestal side panel (122) and comprises two leaves. One leaf has a barrel and the other leaf has a pintle. The pintle is detachably mounted in the barrel.

The pedestal shelf (127) is mounted detachably in the hole pairs of the inner surfaces of the pedestal side panels (122).

By altering where the pedestal drawers (225), the drawer assembly (18), the door (126), the shelf (127) and the stand (14) are mounted, various orientations of the desk can be realized, allowing the person to customize the desk to their requirements. In a first embodiment of the present invention, a longer desk assembly (10) comprises the stand (14), drawer assembly (18), door (126) and shelf (127), whilst a shorter desk assembly (10) comprises two pedestal drawers (225) and is attached to the longer desk assembly (10).

Figure 10:
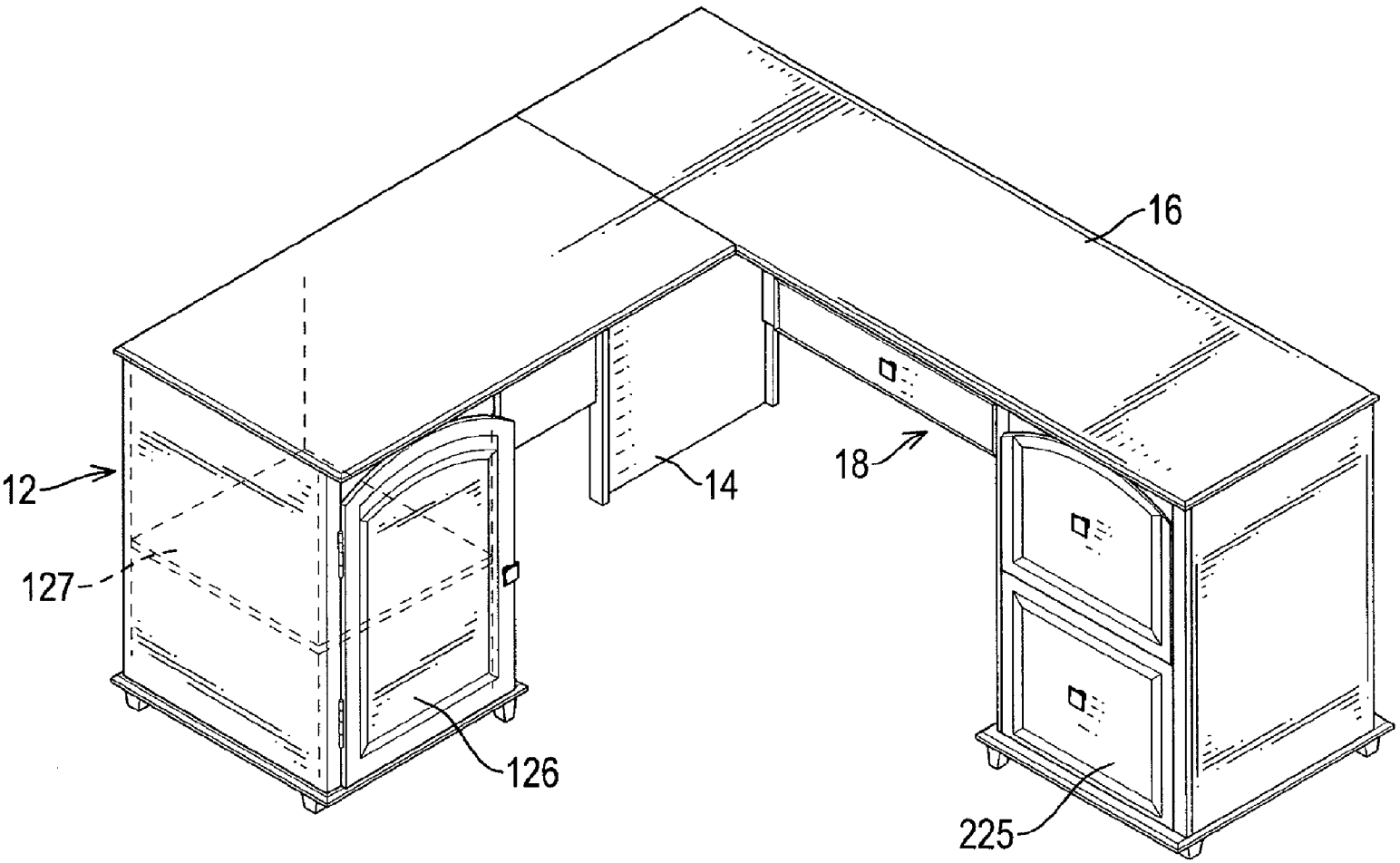
FIG. 10 is a perspective view of a second embodiment of the RTA modular desk in accordance of the present invention.

With further reference to FIG. 10, in a second embodiment, the longer desktop (16) comprises the stand (14), two pedestal drawers (225) and the drawer assembly (18), while the shorter desktop comprises the door (126) and the shelf (127). Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A ready-to-assemble modular desk comprising
- two desk assemblies and each desk assembly having
  - a pedestal having
    - a pedestal base being rectangular and having a rear edge and two side edges;
    - two pedestal side panels each having
      - an inner surface having multiple hole pairs being formed in the inner surface and corresponding to each other;
      - a bottom edge being mounted removably on to the pedestal base using multiple clasp connectors and at least one dowel;
      - a top edge; and
      - a rear edge;
    - a pedestal rear panel corresponding to and being mounted removably on the pedestal base and side panels using multiple clasp connectors and at least one dowel; and
    - a pedestal brace being connected between the pedestal side panels, wherein one of the desk assemblies comprises a stand that comprises at least one leg and is placed parallelly to the pedestal side panels;
  - a desktop being rectangular and having
    - a bottom surface;
    - two side edges being respectively mounted removably on the top edge of the pedestal side panel and the stand using multiple clasp connectors and at least one dowel;
    - a rear edge being mounted removably on the top edge of the pedestal rear panel using multiple clasp connectors and at least one dowel; and
    - a front edge detachably connected to one of the side edges of the other desk assembly using at least one dowel and multiple latch assemblies each comprising
      - a latch being mounted on the bottom surface of the desktop and having
        - a latch mount; and
        - a latch bar being mounted rotatably in the latch mount and having a latching end; and
      - a catch being mounted on the bottom surface of the desktop and having a latch recess corresponding to the latching end of the latch bar;
  - a door having
    - an outer edge; and
    - multiple hinges being mounted pivotally on the outer edge of the door and a corresponding pedestal side panel and comprising two leaves respectively comprising a barrel and a pintle rotatably mounted in the barrel; and
  - at least one pedestal drawer having
    - two sides; and
    - two rails mounted respectively on the sides of the pedestal drawer and in the hole pairs of the inner surface of the pedestal side panel, wherein each clasp connector comprises a clasp recess having an inner chamber and a shoulder formed on and protruding from the inner chamber; and a clasp bar having a base; and a rotating pin having a neck;

a head being formed on and protruding from the neck and corresponding to the inner chamber of the clasp recess; and a lever being mounted on the rotating pin to rotate the pin and lock the clasp connector securely.

2. The ready-to-assemble modular desk as claimed in claim 1, wherein one of the desk assemblies further has a drawer assembly being mounted detachably on the bottom surface of the desktop of the desk assembly and having two side drawer panels being mounted parallelly to the pedestal of the desk assembly and detachably onto the bottom surface of the desktop of the desk assembly using the clasp connectors and the at least one dowel; and a rear drawer panel being detachably mounted between the side drawer panels using the clasp connectors; and a drawer having two drawer side surfaces being slidably mounted between the two side drawer panels; and two drawer rails being mounted respectively on the side surfaces of the drawer and the side drawer panels.

3. The ready-to-assemble modular desk as claimed in claim 2, wherein at least one of the desk assemblies further has a rear cover being a rectangular board and having a top edge being communicated and detachably mounted with the longitudinal rear edge of the desktop of the desk assembly; and two side edges being shorter than the leg of the stand and respectively mounted detachably to the rear edge of the pedestal side panel and the stand using the clasp connectors and the at least one dowel.

4. The ready-to-assemble modular desk as claimed in claim 2, wherein one of the pedestals further has a pedestal shelf being mounted detachably in the hole pairs of the inner surfaces of the pedestal side panels.

* * * * *